United States Patent [19]

Baxter

[11] 4,128,189

[45] Dec. 5, 1978

[54] DEVICE FOR IMPROVING THE POURABILITY OF FLUIDS AND ALSO FORMING AN IMPROVED CLOSURE FOR A CONTAINER OF SUCH FLUIDS

[75] Inventor: Ernest W. Baxter, Van Wert, Ohio

[73] Assignee: National Plastics Corporation, Fort Wayne, Ind.

[21] Appl. No.: 784,287

[22] Filed: Apr. 4, 1977

[51] Int. Cl.[2] ..... B65D 25/42

[52] U.S. Cl. ..... 222/109

[58] Field of Search ..... 222/109, 111, 547, 563, 222/570, 571, 564; 138/44

[56] References Cited

U.S. PATENT DOCUMENTS

| | | | |
|---|---|---|---|
| 2,601,040 | 6/1952 | Livingstone | 222/109 |
| 2,915,223 | 12/1959 | Beall, Jr. | 222/109 |
| 3,217,935 | 11/1965 | Burt | 222/109 |
| 3,331,535 | 7/1967 | Jarvis | 222/94 |
| 3,369,710 | 2/1968 | Lucas | 222/109 |
| 3,434,637 | 3/1969 | Marcel | 222/570 |
| 3,814,287 | 6/1974 | Darbon et al. | 222/94 |
| 3,833,150 | 9/1974 | Maria et al. | 222/109 |

*Primary Examiner*—Joseph F. Peters, Jr.
*Assistant Examiner*—Norman L. Stack, Jr.
*Attorney, Agent, or Firm*—John A. Young

[57] ABSTRACT

In a container for viscous fluids, an insert is fitted within the open end of the bottle and provides a dripless pouring lip after the cover at the open end of the container is removed and the container is up-ended for pouring.

6 Claims, 6 Drawing Figures

DEVICE FOR IMPROVING THE POURABILITY OF FLUIDS AND ALSO FORMING AN IMPROVED CLOSURE FOR A CONTAINER OF SUCH FLUIDS

BACKGROUND OF THE INVENTION

There is a tendency for semiviscous fluids such as syrup, corn oil and the like to drip excessively when poured from the open end of containers for such materials. Not only is such dripping unsightly and messy in handling the bottle, but it is wasteful of the product and necessitates periodic cleaning of the exterior of the container. Since many of these liquids are dispensed by children, the messiness of the operation is well known. Dripping is especially a problem in dispensing cooking oils and the like because it spreads unwanted oil on cooking surfaces.

There is a need for dripless pouring and which will not interfere with "breathing," whereby air can enter the container and replace the dispensed fluid.

PRIOR ART

In the production of dripless spouts for containers having liquids such as syrup, corn oil and other somewhat viscous fluids, there have been proposals for plastic pouring spouts which are added at the open end of the container. These devices are for the most part threadedly secured to the open end of the container and provide a pouring surface which is generally characterized by a rather sharp edge to minimize dripping when the contents of the container are dispensed.

What the present invention proposes, however, is to provide an insert which is fitted wholly within the confines of a container and cap so as to be protected against damage both during transit and shelf life, and which cannot be easily broken or damaged.

The insert which is used and employed by the present invention is one in which the insert is proportioned to fit within the interior of the bottle or other container at its neck portion and having a further section which bears sealingly against the open end of the container and is then sealingly clamped to such end either by a cap or in some other suitable manner.

It is an object of the present invention to provide an insert which can be combined with a glass or metal container having a drip-prone liquid such as, but not limited to, syrups, oils, and the like, and which will provide a pouring surface that will decrease or entirely eliminate the tendency for dripping, the insert being adapted to readily fit within a wide variety of containers whether glass, metal, plastic or the like, and is enclosed within the neck of the container or container neck-and-cap so as to be protected at all times and free of the tendency for contamination of the pouring surface.

It is a principal object of the present invention to provide an improved pouring spout for liquids which tend to be of such viscosity as to cause dripping, and such pouring spout will be effective to provide drip-free operation, thereby obviating the waste and unsightliness which accompany the dripping of fluids over the exterior of the container and onto other surfaces.

Other objects and features of the present invention will become apparent from a consideration of the following description which proceeds with reference to the accompanying drawings wherein selected example embodiments are described by way of illustration of the invention.

DETAILED DESCRIPTION OF THE EMBODIMENTS

Figure 1:
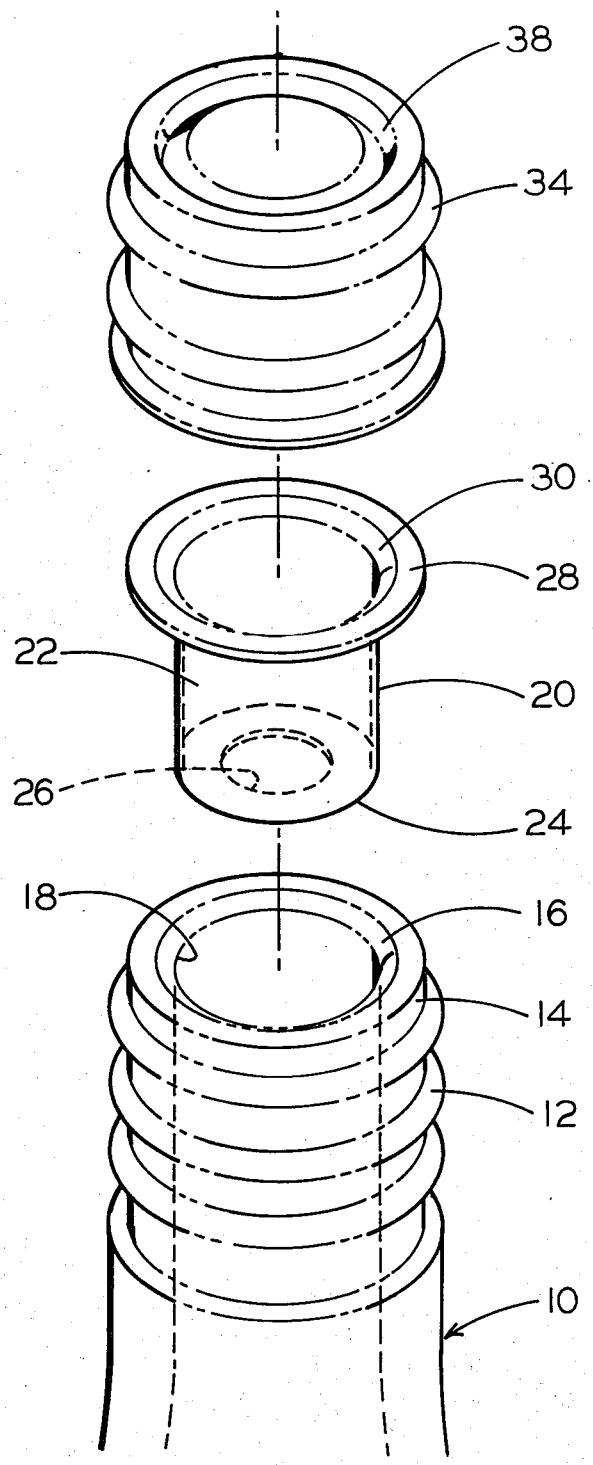
FIG. 1 is an isometric exploded view of one embodiment of the invention.

Referring to FIG. 1, a container designated generally by reference numeral 10 has a threaded exterior 12 at its neck 14. Open end 16 has a pouring edge 18 which previously, by reason of the lack of sharpness of the edge and its general configuration, enabled dripping of the fluid during a pour. The result of such dripping is that the interior contents of the container will flow over the exterior of the container, and also inadvertently upon other surfaces as well. In time the operation becomes messy and objectionable not only because of waste, but also there is necessitated extensive cleaning operations. The wasted fluids on the outside of the container create unsanitary conditions, since the wasted fluids attract flies and other insects. This is particularly the case where there are such fluids as cooking oils, syrups, and other semiviscous fluids which were being dispensed.

Figure 2:
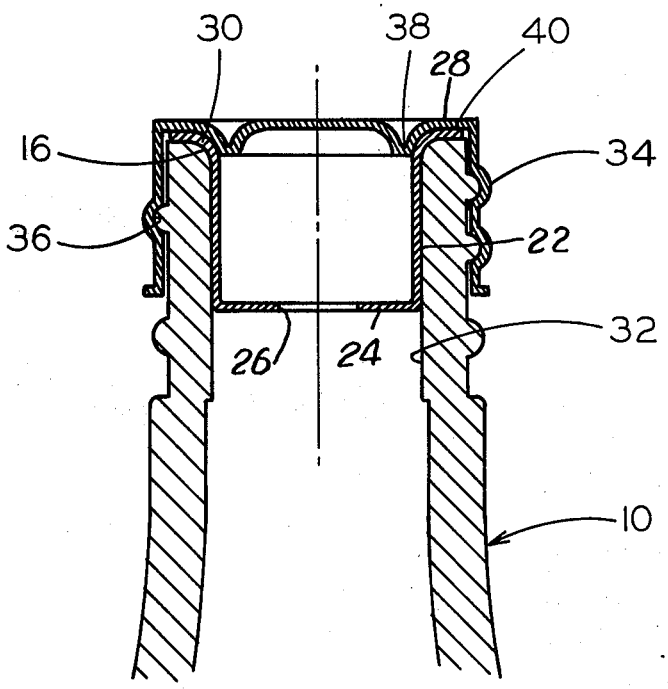
FIG. 2 is an enlarged sectional view taken through the center of the neck of the container after the cap and insert of FIG. 1 are in place.

In the present invention, I provide a polyethylene, polypropylene, or other suitable plastic insert designated generally by reference numeral 20 and consisting of a sleeve 22 with a base 24 having a central opening 26, a flange 28 and a pouring lip 30. The insert is proportioned so that sleeve 22 will fit snugly (FIG. 2) against the interior surface 32 of the neck of the container.

A cap 34 having internal threads 36 is screwed over the threaded exterior 12 of the container 10 and has a circular indentation 38 which bears against the lip 30 and squeezes back into the container 10 any liquid which might be remaining on the lip 30 or its adjoining surfaces.

The cap also has an internal annular shoulder 40 which bears against the flange 28 and clamps it firmly against the open end 16 of the container 10 and forms a firm seal to prevent loss of fluid during transit, and also while the object is on the store shelf awaiting sale.

In operation, the lid 34 is unscrewed from the end of the container and the contents dispensed in the usual manner, passing through the opening 26 in the base 24 of the insert 20 and passing over the sharp edge of the pouring lip 30. Opening 26 is of such a size as to prevent a rush of fluid when the container is turned over for dispensing fluid, and by restricting the flow will prevent occurrence of drips and spills. Because the sharp pouring edge of the lip 30 is nonwettable, by reason of its plastic nature (polyethylene, polypropylene or other such material), so there is a virtually dripless dispensing.

The insert can also be made of any colored material, such as red, yellow, blue, whatever is attractive and blends well with the coloring of the label, the cap, and other parts of the container.

Figure 4:
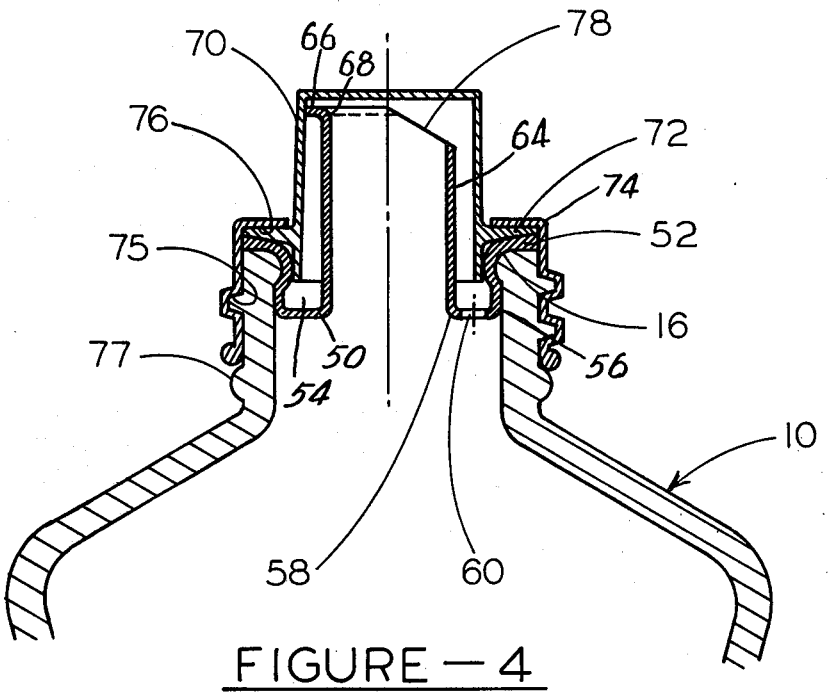
FIG. 4 is an enlarged sectional view taken through the center of the container neck after the cap, cover, and insert of FIG. 3 are in place.
Figure 3:
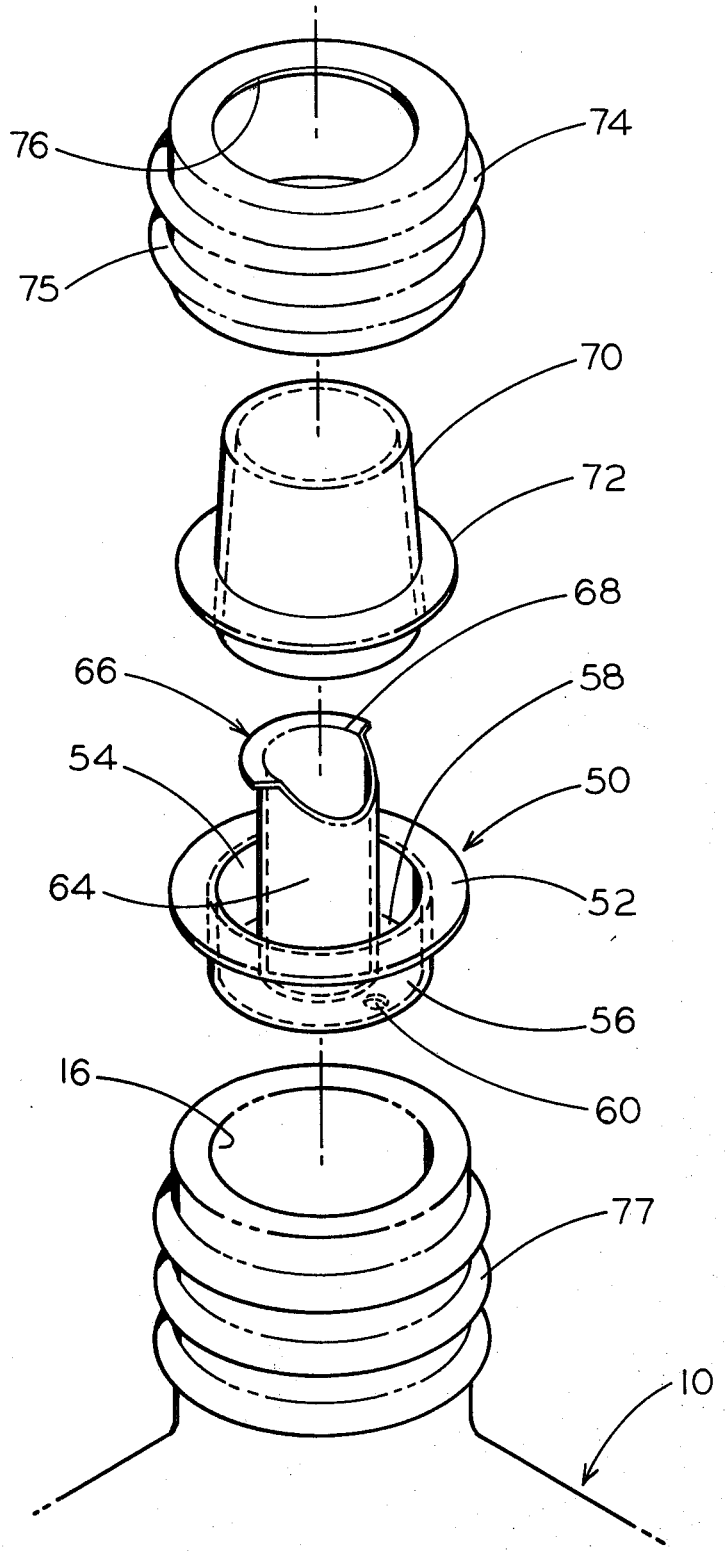
FIG. 3 is an isometric exploded view of a second embodiment of the invention.
Figure 5:
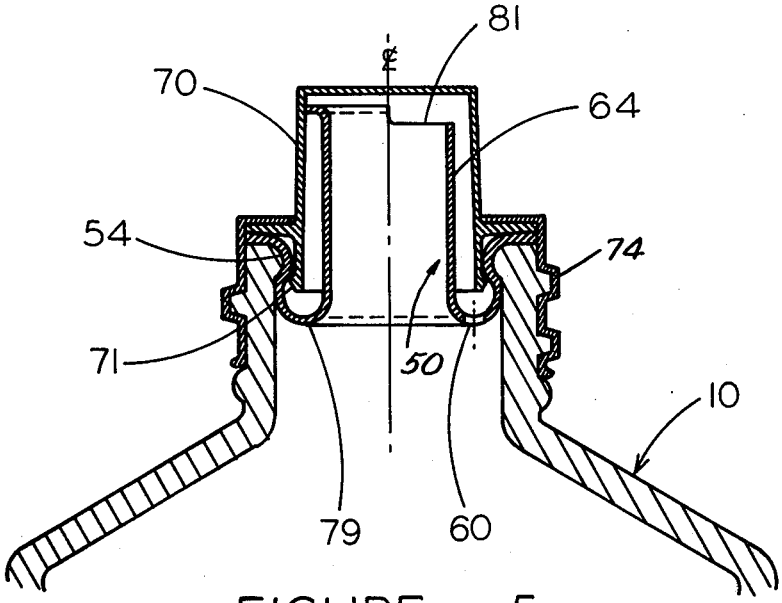
FIG. 5 is a sectional detail view of a modification of the insert shown in FIGS. 3 and 4.

Referring next to the embodiments shown in FIGS. 3, 4, and 5, an insert 50 having an annular flange 52 and a well 54 is fitted into the open end 16 of container 10 with the cylindrical portion 56 fitting snugly against the interior confronting surface of the neck of the container. At the bottom 58 of well 54 is an opening 60 which serves both as a drainage for fluid which finds its way into the well so that it can be drained back into the interior of the bottle, and also serves as a breather opening so that as liquid is dispensed through pouring spout 64, air can enter and displace the withdrawn fluid.

Integrally related with the insert and the base 58, is a pouring spout 64 with a pouring lip 66 having a sharp edge 68. The pouring lip is arcuately formed, that is, it does not extend around the entire periphery of the open end of the spout 64.

A cover 70 is fitted over the spout 64 and has a flange 72 which bears against flange 52 so that when annular cap 74 having internal threads 75, is passed over the cover 70 and screwed onto the external threads 77 of the container, it will bring shoulder 76 into clamping engagement with both flange 72 of cover 70 and flange 52 of insert 50, clamping both against the open end 16 of the container 10, as shown in FIG. 4.

In operation, should the bottle or container 10 be turned upside down with fluid then filling insert 50 after the bottle is again turned upright, any fluid which is located between the cover 70 and insert 50 will enter into the base of the well and drain back into the container through opening 60.

No part of the insert 50 is exposed during shipment or while the container is on the shelf awaiting sale.

After sale, however, the once threaded cap 74 is removed, it can be thrown away, since the frictional grip formed between the sleeve 56 of the insert 50 and the open end of the bottle is sufficient to keep it in place, and the interior of the bottle is sealed by simply fitting the cover 70 over the pouring spout 64 as shown in FIGS. 3 and 4. When it is desired to dispense fluid, the cover 70 is removed and fluid is dispensed through the pouring spout 64 which, is above the open end of the bottle and has a curved surface terminating in a sharp pouring edge. Any fluid which might drip off of the pouring edge is caught in the well 54 and is returned to the interior of the bottle through the drainage opening 60.

In this embodiment as in the previous embodiment, the insert 50 can be formed of plastic material such as polyethylene, polypropylene, or other nonwettable type of plastic material. Furthermore, the insert 50, cover 70, and cap 74 can be variously colored in order to fit into a harmonious color style with the remainder of the container including the label on the container.

Referring next to FIG. 5, the insert 50 can be further modified so that the base 79 is rounded, instead of inclined (FIG. 4); the cutoff 81 at the open end of the spout 64 can be formed squarely, so as to be transverse to the longitudinal axis of the spout (instead of being inclined as indicated by reference numeral 78 in FIG. 4), and the cover 70 can include at its internal open end, a bead 71 which causes it to fit more snugly into the well 54 of the spout.

Since the cover is of flexible plastic material, it can be readily gripped and is deformable so that it can be pinched and easily pulled off the spout and reinserted.

Figure 6:
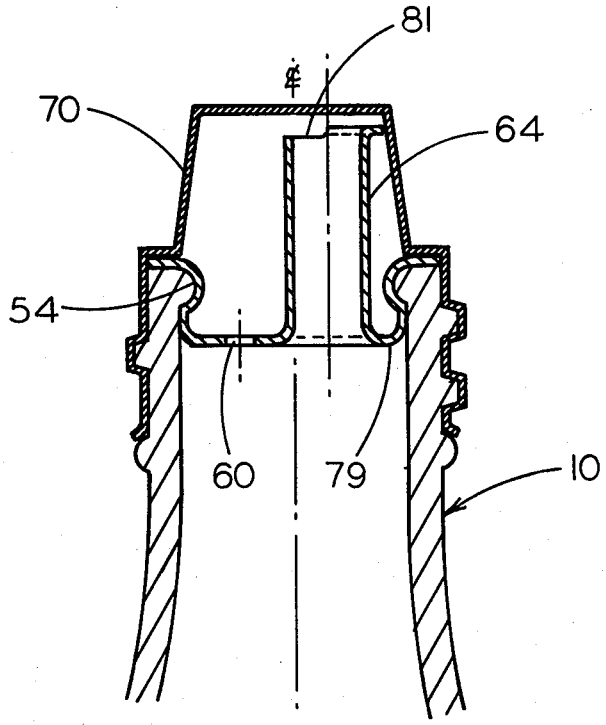
FIG. 6 is a sectional detail view of a still further modification of the insert shown in FIGS. 3 and 4.

Referring next to FIG. 6, the pouring spout 64 extends sufficiently above the level of the open end of the container so that when the bottle is next uprighted the cutoff flow of fluid will not fall on the neck of the container.

The pouring spout 64 does not have to be located concentrically with respect to the insert, but can be located radially offset to preclude any dripping along the side of the container. The location of the pouring lip is important, because it produces a cut-off in the fluid dispensed at a point behind the container and therefore adds an additional safeguard against drippage on the bottle or other container.

By extending the spout 64 well above the open end of the bottle it will facilitate pouring liquid into a shallow member such as a spoon or the like, and that is another purpose in making the spout of longer configuration.

Although the present invention has been illustrated and described in connection with a few selected example embodiments of the invention, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims as equivalents of the invention.

What is claimed is:

1. In combination with a container having an externally threaded open end, an insert for such containers to promote the dripless dispensing of semi-viscous liquids such as oil, syrup, and the like, comprising a circular flange adapted to bear sealingly against the open end of the container, and an integrally related annular well proportioned to fit within the container and disposed below the open end of the container and including means forming a drainage opening within the base thereof, and a pouring spout formed from a reverse bend within said well integrally related to said insert, and extending substantially above the circular flange and having a pouring lip disposed diametrically from said drainage opening and with a sharp pouring edge which contributes to dripless pouring from the interior of the container through said spout and providing a run-back surface leading to said well where the fluid is returned to the interior of the container at the level of said well, and a screw-on cap threadedly received over the threaded exterior at the open end of said container and including a shoulder adapted to exert clamping effort against the pouring edge and which clamps the circular shoulder of said insert sealingly against the open end of the container and prevents pouring out of said spout until said cap is removed.

2. The structure in accordance with claim 1 in which said cap consists of two individual members, one forming a cover over said spout, the other member of the cap consisting of a threaded sleeve and shoulder for urging the cover and shoulder of said insert against the open end of the container.

3. The structure in accordance with claim 1 in which said insert includes an annular well of curvilinear cross-section to collect liquid which runs over the external surface of said pouring spout.

4. The construction in accordance with claim 3 in which said cover includes a bead which is press-fitted within the well of said insert.

5. The construction in accordance with claim 1 in which said pouring spout is cut off squarely, and at least a portion of said spout extends beyond to form a liquid cutoff and includes a sharply configured radius to obtain substantially dripless pouring of the contents of said container.

6. The container and spout in accordance with claim 1 in which the pouring spout is cut off at an angle inclined to the longitudinal axis of said spout.

* * * * *